US011104157B2

(12) United States Patent
Kudo et al.

(10) Patent No.: US 11,104,157 B2
(45) Date of Patent: Aug. 31, 2021

(54) PRINTING APPARATUS

(71) Applicant: SEIKO EPSON CORPORATION, Tokyo (JP)

(72) Inventors: Shun Kudo, Shonai-machi (JP); Kenji Otokita, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/879,085

(22) Filed: May 20, 2020

(65) Prior Publication Data

US 2020/0369043 A1 Nov. 26, 2020

(30) Foreign Application Priority Data

May 23, 2019 (JP) ..... JP2019-096900

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/0015; B41J 2/01; B41J 29/38
See application file for complete search history.

(56) References Cited

U.S. PATENT DOCUMENTS

2018/0304643 A1* 10/2018 LeStrange ..... H01J 37/32449

FOREIGN PATENT DOCUMENTS

| | | |
|---|---|---|
| JP | 2003-191594 | 7/2003 |
| JP | 2011-083969 | 4/2011 |

* cited by examiner

*Primary Examiner* — Bradley W Thies
(74) *Attorney, Agent, or Firm* — Workman Nydegger

(57) ABSTRACT

A printing apparatus is provided in which at least one type of a printing medium is usable, the printing apparatus including a surface treatment unit configured to modify, by varying an output therefrom, a surface state of the printing medium to a plurality of modified states, a head configured to discharge at least one type of an ink of ultraviolet-curable type onto the printing medium having the surface state modified by the surface treatment unit thereby forming an image, an ultraviolet irradiation unit configured to irradiate with an ultraviolet ray the printing medium on which the image is formed by the head, thereby curing the ink, a storage unit configured to store a relationship between the output from the surface treatment unit and the modified state, and a control unit configured to control the output from the surface treatment unit, based on the relationship stored in the storage unit.

6 Claims, 6 Drawing Sheets

PRINTING APPARATUS

The present application is based on, and claims priority from JP Application Serial Number 2019-096900, filed May 23, 2019, the disclosure of which is hereby incorporated by reference herein in its entirety.

BACKGROUND

1. Technical Field

The disclosure relates to a printing apparatus.

2. Related Art

In the related art, a printing apparatus is used, in which an ink of ultraviolet-curable type is discharged from a head, and ultraviolet rays are irradiated from an ultraviolet irradiation unit to cure the ink, to form an image on a printing medium being transported. Such printing apparatuses include a printing apparatus configured to temporarily cure the ink and to then mainly cure the ink. For example, JP 2011-83969 A discloses a printing apparatus including a head configured to discharge an ink of ultraviolet-curable type, a preliminary irradiation unit configured to temporarily cure the ink, and a main irradiation unit configured to mainly cure the ink. There is also a printing apparatus configured to change the irradiation conditions of the ultraviolet rays from an ultraviolet irradiation unit in order to improve the image quality among printing apparatuses that use the ink of ultraviolet-curable type. For example, JP 2003-191594 A discloses a recording device configured to change the irradiation conditions of active light rays such as ultraviolet rays in order to improve the image quality.

The image quality is improved by temporarily curing the ink and then mainly curing the ink in a printing apparatus that uses the ink of ultraviolet-curable type. However, in the printing apparatus configured to temporarily cure the ink of ultraviolet-curable type and to then mainly cure the ink, a temporary curing unit is generally formed in the vicinity of the head, and thus, the ultraviolet rays irradiated from the temporary curing unit reach the head to cure the ink in the nozzles of the head, which may lead to a discharge failure of the ink. Accordingly, reducing the temporary curing makes it possible to reduce the discharge failure of the ink, the performing the maintenance processing for suppressing the discharge failure of the ink, and the like. Thus, there is a demand to improve the image quality while reducing the need for the temporary curing.

SUMMARY

A printing apparatus according to the present disclosure for resolving the above-described issue is configured such that at least one type of a printing medium is usable, the printing apparatus including a surface treatment unit configured to modify, by varying an output therefrom, a surface state of the printing medium to a plurality of modified states, a head configured to discharge at least one type of an ink of ultraviolet-curable type onto the printing medium having the surface state modified by the surface treatment unit, thereby forming an image, an ultraviolet irradiation unit configured to irradiate with an ultraviolet ray the printing medium on which the image is formed by the head, thereby curing the ink, a storage unit configured to store a relationship between the output from the surface treatment unit and the modified, and a control unit configured to control the output from the surface treatment unit, based on the relationship stored in the storage unit.

DESCRIPTION OF EXEMPLARY EMBODIMENTS

Figure 1:
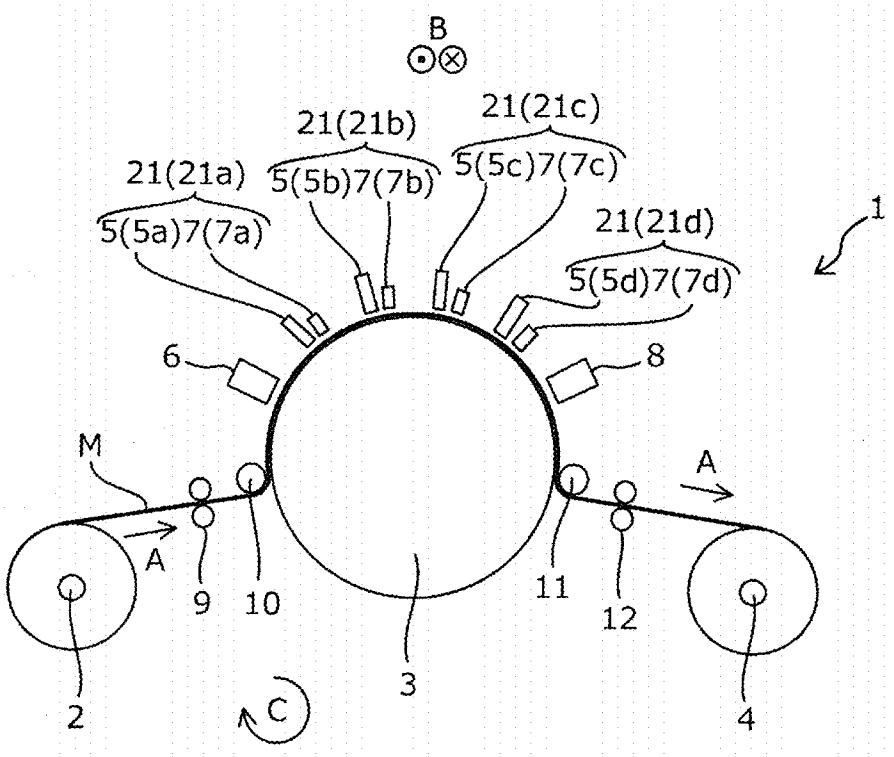
FIG. 1 is a schematic side view of a printing apparatus according to one example of the present disclosure.

First, the present disclosure will be schematically described.

A printing apparatus according to a first aspect of the present disclosure for resolving the above-described issue is configured to process at least one type of a printing medium, the printing apparatus including a surface treatment unit configured to modify, by varying an output therefrom, a surface state of the printing medium to a plurality of modified states, a head configured to discharge at least one type of an ink of ultraviolet-curable type to the printing medium having the surface state modified by the surface treatment unit to form an image, an ultraviolet irradiation unit configured to irradiate the printing medium on which the image is formed by the head with ultraviolet rays to cure the ink, a storage unit in which a relationship between the output from the surface treatment unit and the modified state is stored, and a control unit configured to control the output from the surface treatment unit based on the relationship stored in the storage unit.

Modifying the surface state of the printing medium improves the image quality of an image formed on the modified printing medium. According to the above aspect, the surface treatment unit configured to modify the surface state of the printing medium to a plurality of modified states is provided, making it possible to control the output from the surface treatment unit based on the relationship between the output from the surface treatment unit and the modified state to perform printing, thus improving the image quality while reducing the need for the temporary curing, such as an omission of the temporary curing depending on the printing conditions or the like, for example.

A printing apparatus according to a second aspect of the present disclosure is the printing apparatus according to the first aspect, in which the printing apparatus is configured to process a plurality of types of the printing media, and the storage unit is configured to store the relationship for each of the printing media.

According to the above aspect, a plurality of types of the printing media can be processed, and the relationship between the output from the surface treatment unit and the modified state is stored in the storage unit for each of the printing media, thus making it possible to appropriately modify the surface state of the printing medium in accordance with the printing medium that is processed.

A printing apparatus according to a third aspect of the present disclosure is the printing apparatus according to the first or second aspect, including a temporary curing unit configured to irradiate the ink discharged to the printing medium with ultraviolet rays prior to an irradiation with ultraviolet rays in the ultraviolet irradiation unit to temporarily cure the ink, in which the printing apparatus has a temporary curing execution printing mode for performing printing with irradiating ultraviolet rays from the temporary curing unit and a temporary curing non-execution printing mode for performing printing without irradiating ultraviolet rays from the temporary curing unit, and in which the control unit is configured to control the output from the surface treatment unit at least when performing printing in the temporary curing non-execution printing mode.

According to the above aspect, the temporary curing unit is included, thus making it possible to perform the modification of the surface state of the printing medium and the temporary curing, in a selected or combined manner, depending on the printing conditions such as the image to be printed and the ink to be used.

A printing apparatus according to a fourth aspect of the present disclosure is the printing apparatus according to the third aspect, in which the printing apparatus is configured to use a plurality of types of the inks, and the control unit is configured to execute control such that the printing is performed in the temporary curing non-execution printing mode when performing printing using one type of the ink.

According to the above aspect, it is preferred to perform printing in the temporary curing execution printing mode because when using a plurality of types of inks, different types of inks discharged to the printing medium are occasionally mixed with each other to cause bleeding, however, the bleeding does not occur when performing printing using one type of the ink, thus making it possible to suppress an ink mist from adhering to the head to be cured by performing printing in the temporary curing non-execution printing mode.

A printing apparatus according to a fifth aspect of the present disclosure is the printing apparatus according to the third aspect, including a selection unit configured to select whether to perform printing in the temporary curing execution printing mode or in the temporary curing non-execution printing mode.

According to the above aspect, the selection unit configured to select whether to perform printing in the temporary curing execution printing mode or in the temporary curing non-execution printing mode is included, thus making it possible to select whether to perform printing in the temporary curing execution printing mode or in the temporary curing non-execution printing mode, depending on the image to be printed, the ink to be used, and the like.

A printing apparatus according to a sixth aspect of the present disclosure includes a surface treatment unit configured to modify a surface state of a printing medium, a head configured to discharge an ink of ultraviolet-curable type to the printing medium having the surface state modified by the surface treatment unit to form an image, an ultraviolet irradiation unit configured to irradiate the printing medium on which the image is formed by the head with ultraviolet rays to cure the ink, a temporary curing unit configured to irradiate the ink discharged to the printing medium with ultraviolet rays prior to an irradiation with ultraviolet rays in the ultraviolet irradiation unit to temporarily cure the ink, a selection unit configured to select whether to execute a temporary curing execution printing mode for performing printing with irradiating ultraviolet rays from the temporary curing unit or a temporary curing non-execution printing mode for performing printing without irradiating ultraviolet rays from the temporary curing unit, and a control unit configured to control an output from the surface treatment unit.

According to the above aspect, the selection unit configured to select whether to perform printing in the temporary curing execution printing mode or in the temporary curing non-execution printing mode is included, thus making it possible to select whether to perform printing in the temporary curing execution printing mode or in the temporary curing non-execution printing mode, depending on the image to be printed, the ink to be used, and the like. This makes it possible to improve the image quality while reducing the need for the temporary curing.

The embodiments of the present disclosure will be described below with reference to the accompanying drawings.

First, an overview of a printing apparatus 1 according to one example of the present disclosure will be described with reference to FIG. 1.

The printing apparatus 1 according to the example, which is a printing apparatus configured to print an image on a printing medium M such as paper, cloth, film, or the like, is communicably coupled to a non-illustrated computer, which is an external device. Note that, as illustrated in FIG. 1, the printing apparatus 1 according to the example is configured to perform printing on the printing medium M wound in a rolled form, and may be configured to perform printing on the printing medium M of a single sheet type such as cut paper as well.

As illustrated in FIG. 1, the printing apparatus 1 according to the example includes a feeding unit 2 configured to rotate in a rotation direction C to feed out the printing medium M from the printing medium M in a rolled form that is set in the printing apparatus 1. The feeding unit 2 feeds out the printing medium M to a first transport roller pair 9. Then, the printing medium M is transported by the first transport roller pair 9 in a transport direction A.

The printing medium M transported by the first transport roller pair 9 reaches, via a relay roller 10, a transport drum 3 being a support portion of the printing medium M, and is transported in a state of being in close contact with the transport drum 3 that rotates in the rotation direction C. In a position facing the transport drum 3, four pieces of head units 21 are formed, where the head unit 21 includes a head 5 configured to discharge an ink of ultraviolet-curable type and a temporary irradiation unit 7 including an ultraviolet irradiation unit configured to irradiate ultraviolet rays for temporary curing from an LED. Specifically, as the head unit 21, there are formed a head unit 21*a* constituted by a head 5*a* corresponding to cyan ink and a temporary irradiation unit 7*a*, a head unit 21*b* constituted by a head 5*b* corresponding to magenta ink and a temporary irradiation unit 7*b*, a head unit 21*c* constituted by a head 5*c* corresponding to yellow ink and a temporary irradiation unit 7*c*, and a head unit 21*d* constituted by a head 5*d* corresponding to black ink and a temporary irradiation unit 7*d*. Further, a main irradiation unit 8 being an ultraviolet irradiation unit for mainly curing an ink of ultraviolet-curable type is formed downstream, in the transport direction A, of the four pieces of the head units 21 at the position facing the transport drum 3. Note that all of the head unit 21*a*, the head unit 21*b*, the head unit 21*c*, and the head unit 21*d* have the same shape.

The printing apparatus 1 according to the example is also formed with a corona discharge unit being a surface treatment unit 6 configured to modify the surface of the printing medium M by subjecting the printing medium M to corona discharge treatment, where the printing medium M is being transported in a state of being in close contact with the transport drum 3 upstream, in the transport direction A, of the four pieces of the head units 21. As described in detail later, the surface is modified by the surface treatment unit 6, to thus improve the quality of the image formed on the printing medium M by the head unit 21. Note that the printing apparatus 1 according to the example includes the corona discharge unit as the surface treatment unit 6, and may also include the surface treatment unit 6 other than the corona discharge unit, such as a plasma discharge unit. The surface treatment unit 6 according to the example is configured to vary the output to modify the surface state of the printing medium M to a plurality of modified states.

An image is formed by the four pieces of the head units 21 on the printing medium M being transported in a state of being in close contact with the transport drum 3. Then, the image formed on the printing medium M by the four pieces of the head units 21 is fixed to the printing medium M by mainly curing the ink that forms the image by the main irradiation unit 8. Note that the printing apparatus 1 according to the example has an irradiation intensity of the ultraviolet rays from the main irradiation unit 8, which is more intense than the irradiation intensity of the ultraviolet rays from the temporary irradiation unit 7. In other words, the printing apparatus 1 according to the example causes the irradiation of the ultraviolet rays from the temporary irradiation unit 7 to temporarily cure the ink discharged to the printing medium M, to thus suppress the ink from being excessively spread, and causes the irradiation of the ultraviolet rays from the main irradiation unit 8 to cure the ink, to thus fix the ink to the printing medium M.

Further, a tension roller 11 is provided downstream, in the transport direction A, of the main irradiation unit 8, where the printing medium M is transported from the transport drum 3, via the tension roller 11, to a second transport roller pair 12. Then, the printing medium M transported by the second transport roller pair 12 is wound in a rolled form by causing the winding unit 4 to rotate in the rotation direction C.

Here, all of the heads 5 of the printing apparatus 1 according to the example is a line head having nozzles formed in a line form along the width direction B of the printing medium M. In other words, the printing apparatus 1 according to the example is a so-called line printer configured to perform continuous printing while continuously transporting the printing medium M. However, the printing apparatus 1 may be a printer including a head configured to discharge an ink while reciprocatively moving in a direction intersecting the transport direction A.

Figure 2:
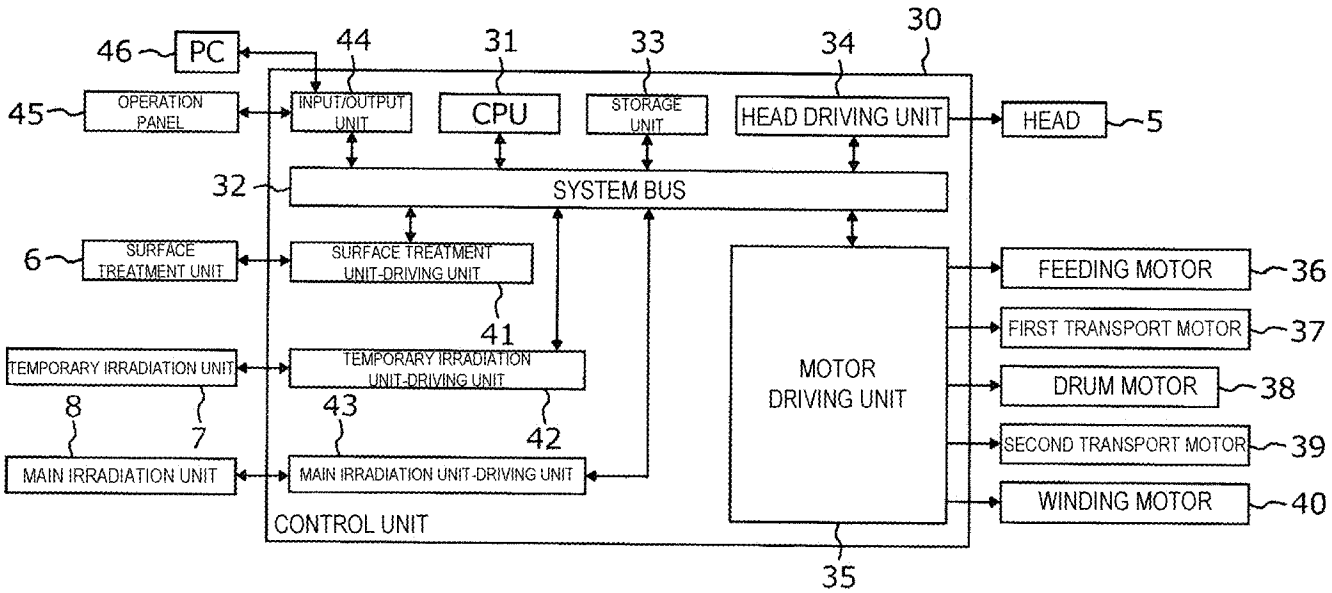
FIG. 2 is an electric block diagram illustrating an electrical configuration of a printing apparatus according to one example of the present disclosure.

Next, the electrical configuration of the printing apparatus 1 according to the example will be described with reference to FIG. 2.

A control unit 30 includes a CPU 31 configured to manage the entire control of the printing apparatus 1. The CPU 31 is coupled, via a system bus 32, with a ROM configured to store, for example, various types of control programs and the like to be executed by the CPU 31, and with a storage unit 33 including a RAM, an EEPROM, and the like that are configured to temporarily store data. Here, the storage unit 33 stores data indicating the relationship between the output from the surface treatment unit 6 and the modified state of the printing medium M.

The CPU 31 is also coupled, via the system bus 32, with a head driving unit 34 for driving the head 5 to discharge an ink.

The CPU 31 is also coupled, via the system bus 32, with a motor driving unit 35 coupled with a feeding motor 36, a first transport motor 37, a drum motor 38, a second transport motor 39, and a winding motor 40. Here, the feeding motor 36 serves as a rotating mechanism of the feeding unit 2, and is a motor configured to drive the feeding unit 2 to feed out the printing medium M to the first transport motor 37. Further, the first transport motor 37 is a motor for driving the first transport roller pair 9. Further, the drum motor 38 is a motor for rotating the transport drum 3 in the rotation direction C. In addition, the second transport motor 39 is a motor for driving the second transport roller pair 12. Further, the winding motor 40 is a motor for driving the winding unit 4 to wind the printing medium M in a rolled form.

The CPU 31 is further coupled, via the system bus 32, with a surface treatment unit-driving unit 41 for driving the surface treatment unit 6 to modify the surface of the printing medium M. The CPU 31 is further coupled, via the system bus 32, with a temporary irradiation unit-driving unit 42 for driving the temporary irradiation unit 7 to irradiate the printing medium M with ultraviolet rays. The CPU 31 is further coupled, via the system bus 32, with a main irradiation unit-driving unit 43 for driving the main irradiation unit 8 to irradiate the printing medium M with ultraviolet rays.

The CPU 31 is further coupled, via the system bus 32, with an operation panel 45 configured to accept a command from the user such as input of data by the user, a PC 46 for sending and receiving data such as image data, and signals, and the like, via an input/output unit 44.

Next, the image quality improvement effect due to the usage of the surface treatment unit 6, which is a main part of the printing apparatus 1 according to the example, will be described with reference to FIGS. 3 to 6.

Figure 3:
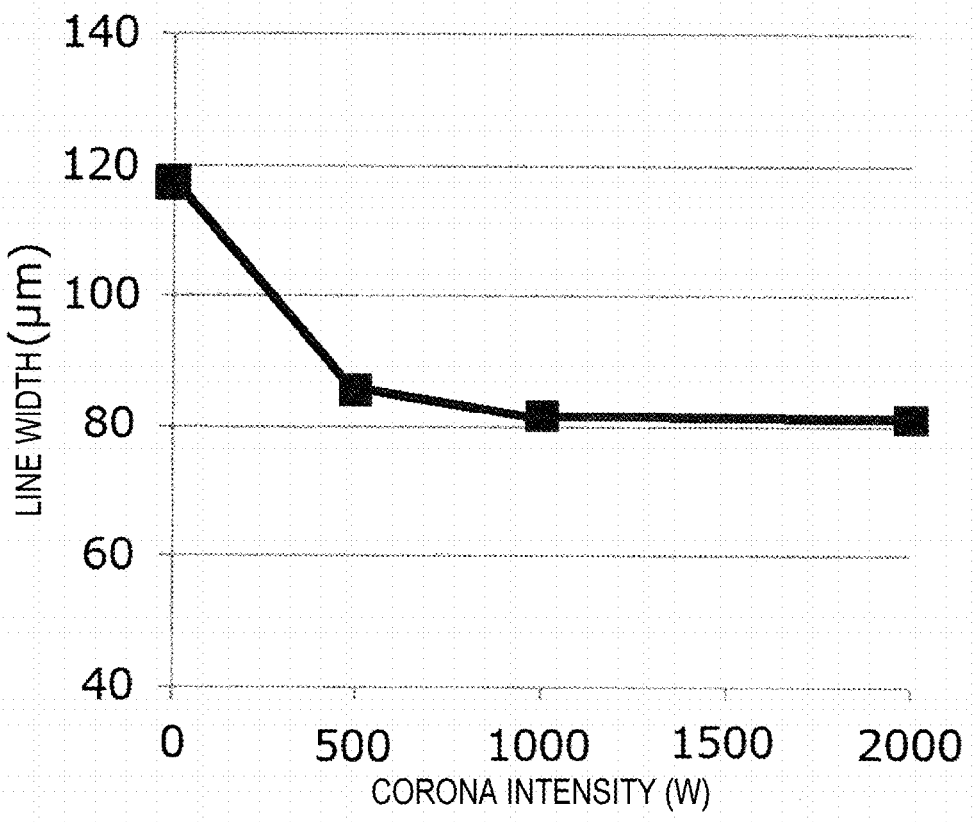
FIG. 3 is a graph illustrating a relationship between an output from a surface treatment unit and a line width of an image when performing printing using a printing apparatus according to one example of the present disclosure.

The printing apparatus 1 according to the example is configured to process a plurality of types of the printing media M, where FIG. 3 is a graph illustrating the relationship between the corona intensity, which is the output from the surface treatment unit 6, and the line width of an image when the printing medium M according to one example, among the printing media M, is processed. As illustrated in FIG. 3, the line width can be narrowed by subjecting the printing medium M to corona discharge treatment.

Figure 4:
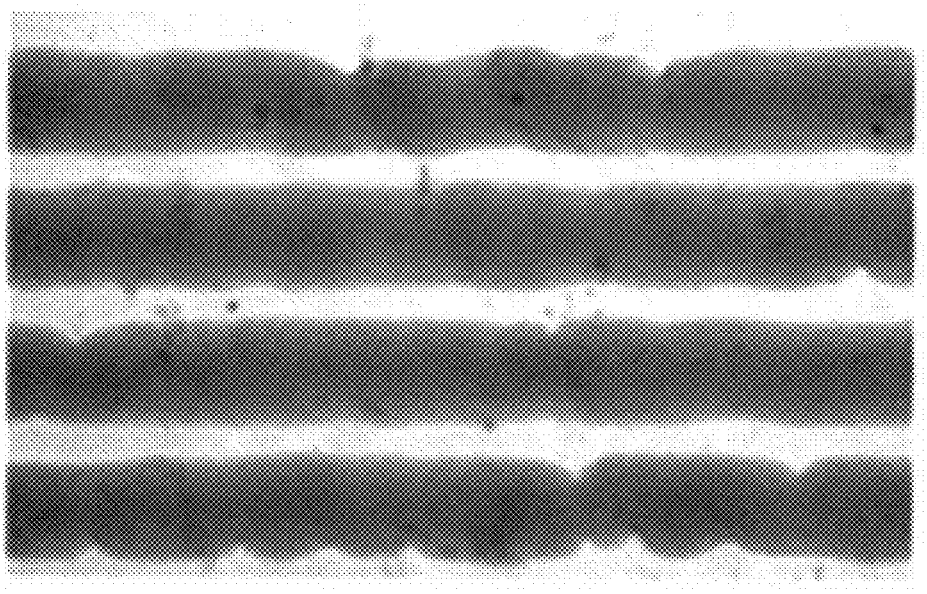
FIG. 4 is an example of an image printed, without performing surface treatment by a surface treatment unit, using a printing apparatus according to one example of the present disclosure.
Figure 5:
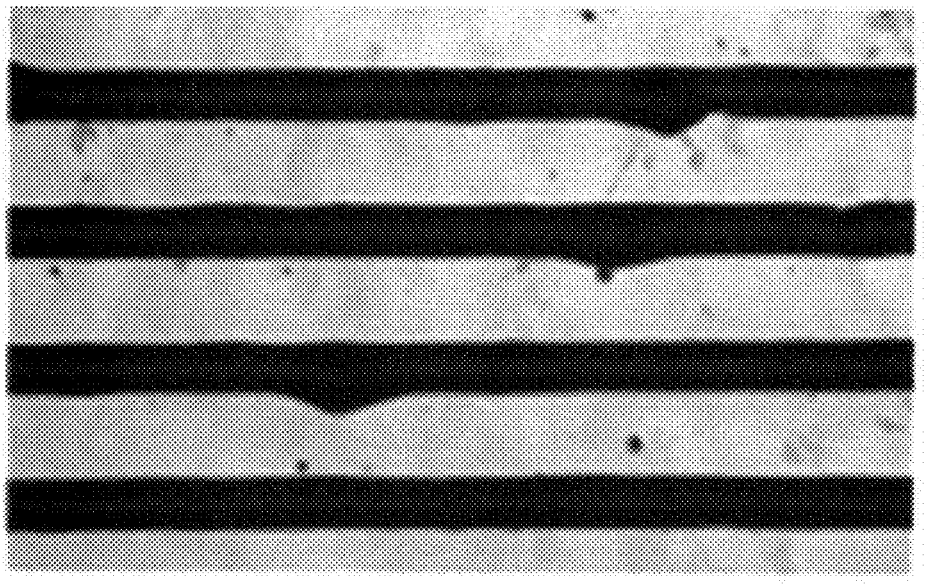
FIG. 5 is an example of an image printed, with performing surface treatment by a surface treatment unit, using a printing apparatus according to one example of the present disclosure.

Also, FIGS. 4 and 5 are photographs of a line image when the printing medium M processed in FIG. 3 is processed. Further, FIG. 4 illustrates an image in which four lines are formed on the printing medium M when the corona intensity is 0 W, that is, without subjecting the printing medium M to corona discharge treatment. On the other hand, FIG. 5 illustrates an image in which four lines are formed on the printing medium M by subjecting the printing medium M to corona discharge treatment, to cause the output from the surface treatment unit 6, that is, the corona intensity, to be 500 W. As is apparent from a comparison of FIG. 4 with FIG. 5, the lines are formed, causing bleeding and spreading in FIG. 4, while the lines are formed with sharp lines in FIG. 5.

Note that in FIG. 3, adjusting the output from the surface treatment unit 6 to cause the corona intensity to be 500 W, results in the lines having almost favorable line width. Accordingly, when processing the printing medium M in FIGS. 3 to 5, it is preferred that the corona intensity be 500 W. Further, in the storage unit 33 of the printing apparatus 1 according to the example, data indicating the relationship between the favorable output from the surface treatment unit 6 in accordance with the types of the printing media M, and in other words, data indicating the relationship between the output from the surface treatment unit 6 for each of the printing media M and the modified state of the surface of the printing medium M.

Figure 6:
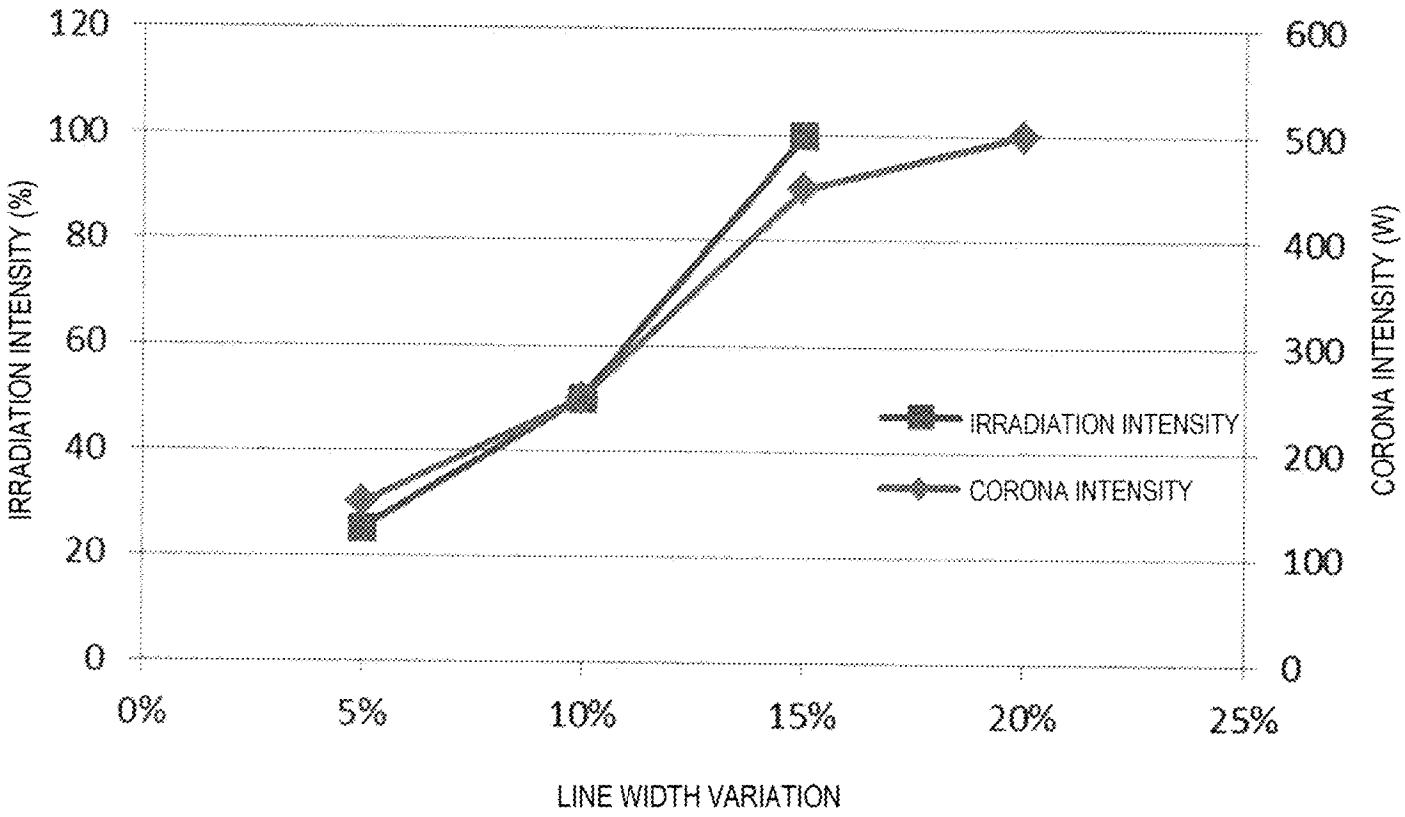
FIG. 6 is a graph illustrating a relationship between an output from a surface treatment unit and a line width of an image and a relationship between an output from a temporary curing unit and a line width of an image when performing printing using a printing apparatus according to one example of the present disclosure.

Note that, as described above, the printing apparatus 1 according to the example includes the temporary irradiation unit 7. Driving the temporary irradiation unit 7 without performing corona discharge also achieves the image quality improvement effect. FIG. 6 is a graph for comparing the effect of narrowing the line width without performing corona discharge with driving the temporary irradiation unit 7, and the effect of narrowing the line width with performing corona discharge without driving the temporary irradiation unit 7. As illustrated in FIG. 5, the image quality improvement effect can be achieved by performing at least one of the corona discharge or the temporary irradiation.

However, there may be a case where the image quality improvement effect obtained by performing the corona discharge differs from the image quality improvement effect obtained by performing temporary irradiation. This is because the corona discharge improves the image quality by modifying the surface state of the printing medium M to alter the wettability of the ink with respect to the printing medium M, while the temporary irradiation improves the image quality by temporarily curing the ink, that is, curing the ink to a certain degree. Such a difference makes it possible to suppress different inks adjacent to each other on the surface of the printing medium M from being mixed with each other by performing temporary irradiation. On the other hand, performing corona discharge without performing temporary irradiation makes it possible to suppress ultraviolet rays from reaching the head 5 to cause a discharge failure. That is, performing temporary irradiation is particularly effective when using a plurality of types of inks, while performing corona discharge is particularly effective when using one type of ink (for example, barcode printing).

Here, to once summarize, the printing apparatus 1 according to the example is configured to process at least one type of the printing medium M, the printing apparatus 1 including the surface treatment unit 6 configured to vary the output to modify the surface state of the printing medium M to a plurality of modified states, the head 5 configured to discharge at least one type of an ink of ultraviolet-curable type to the printing medium having the surface state modified by the surface treatment unit 6 to form an image, the main irradiation unit 8 as an ultraviolet irradiation unit configured to irradiate the printing medium M on which the image is formed by the head 5 with ultraviolet rays to cure the ink, and the storage unit 33 in which the relationship between the output from the surface treatment unit 6 and the modified state is stored. Further, in the printing apparatus 1 according to the example, the control unit 30 is configured to control the output from the surface treatment unit 6 based on the relationship between the output from the surface treatment unit 6 and the modified state, which is stored in the storage unit 33.

Modifying the surface state of the printing medium M improves the image quality of an image formed on the printing medium M thus modified. As described above, the printing apparatus 1 according to the example, which includes the surface treatment unit 6 configured to modify the surface state of the printing medium M to a plurality of modified states, controls the output from the surface treatment unit 6 based on the relationship between the output from the surface treatment unit 6 and the modified state to perform printing. Accordingly, separately using the temporary curing by the temporary irradiation unit 7 and the corona discharge by the surface treatment unit 6 depending on the need makes it possible to improve the image quality while reducing the need for the temporary curing, such as an omission of the temporary curing depending on the printing conditions or the like, for example.

As described above, the printing apparatus 1 according to the example is also configured to process a plurality of types of the printing media M, and the storage unit 33 stores the relationship between the output from the surface treatment unit 6 and the modified state for each of the printing media M. Accordingly, the printing apparatus 1 according to the example can appropriately modify the surface state of the printing medium M in accordance with the printing medium M.

As described above, the printing apparatus 1 according to the example also includes the temporary irradiation unit 7 being the temporary curing unit configured to irradiate the ink discharged to the printing medium M to temporarily cure the ink prior to the irradiation with ultraviolet rays by the main irradiation unit 8. The printing apparatus 1 according to the example also has the temporary curing execution printing mode for performing printing with irradiating ultraviolet rays from the temporary irradiation unit 7, and a temporary curing non-execution printing mode for performing printing without irradiating ultraviolet rays from the temporary irradiation unit 7. Further, the control unit 30 is configured to control the output from the surface treatment unit 6 at least when performing printing in the temporary curing non-execution printing mode. As described above, the printing apparatus 1 according to the example, which includes the temporary irradiation unit 7, performs the modification of the surface state of the printing medium M and the temporary curing, in a selected or combined manner, depending on the printing conditions such as the image to be printed and the ink to be used.

As described above, the printing apparatus 1 according to the example, which also includes four pieces of the heads 5, can use cyan ink, magenta ink, yellow ink, and black ink, that is, a plurality of types of inks. Further, the control unit 30 is configured to execute control such that the printing is performed in the temporary curing non-execution printing mode when performing printing using one type of ink. It is preferred to perform printing in the temporary curing execution printing mode because when using a plurality of types of inks, different types of inks discharged to the printing medium M are occasionally mixed with each other to cause bleeding, however, the bleeding does not occur when performing printing using one type of the ink, thus making it possible to suppress an ink mist from adhering to the temporary irradiation unit 7 to be cured by performing printing in the temporary curing non-execution printing mode.

As described above, the printing apparatus 1 according to the example also includes the operation panel 45. The user may then use the operation panel 45 to select whether to perform printing in the temporary curing execution printing mode or in the temporary curing non-execution printing mode. As such, the printing apparatus 1 according to the example, which includes the operation panel 45 being a selection unit configured to select whether to perform printing in the temporary curing execution printing mode or in the temporary curing non-execution printing mode, makes it possible to select whether to perform printing in the temporary curing execution printing mode or in the temporary curing non-execution printing mode, depending on the image to be printed, the ink to be used, and the like. Note that in both of the temporary curing execution printing mode and the temporary curing non-execution printing mode, the printing apparatus 1 according to the example is configured to select whether to perform printing with performing corona discharge by the surface treatment unit 6 or to perform printing without performing corona discharge.

To provide an explanation from another point of view, the printing apparatus 1 according to the example includes the surface treatment unit 6 configured to modify the surface state of the printing medium M, the head 5 configured to discharge an ink of ultraviolet-curable type to the printing medium M having the surface state modified by the surface treatment unit 6 to form an image, and the main irradiation unit 8 configured to irradiate the printing medium M on which the image is formed by the head 5 with ultraviolet rays to cure the ink, and the temporary irradiation unit 7 configured to irradiate the ink discharged to the printing medium M with ultraviolet rays prior to the irradiation with ultraviolet rays to temporarily cure the ink, the operation panel 45 configured to select whether to execute the temporary curing execution printing mode for performing printing with irradiating ultraviolet rays from the temporary irradiation unit 7 or the temporary curing non-execution printing mode for performing printing without irradiating ultraviolet rays from the temporary irradiation unit 7, and the control unit 30 configured to control the output from the surface treatment unit 6.

As such, the printing apparatus 1 according to the example, which includes the operation panel 45 configured to select whether to perform printing in the temporary curing execution printing mode or in the temporary curing non-execution printing mode, makes it possible to select whether to perform printing in the temporary curing execution printing mode or in the temporary curing non-execution printing mode, depending on the image to be printed, the ink to be used, and the like. This makes it possible to improve the image quality while reducing the need for the temporary curing.

Note that the disclosure is not limited to the aforementioned example, and many variations are possible within the scope of the disclosure as described in the appended claims. It goes without saying that such variations also fall within the scope of the disclosure.

What is claimed is:

1. A printing apparatus, in which at least one type of a printing medium is usable, the printing apparatus comprising:

a surface treatment unit configured to modify, by varying an output therefrom, a surface state of the printing medium to a plurality of modified states;

a head configured to discharge at least one type of an ink of ultraviolet-curable type onto the printing medium having the surface state modified by the surface treatment unit, thereby forming an image;

an ultraviolet irradiation unit configured to irradiate with an ultraviolet ray the printing medium on which the image is formed by the head, thereby curing the ink;

a storage unit configured to store a relationship between the output from the surface treatment unit and the modified state; and a control unit configured to control the output from the surface treatment unit, based on the relationship stored in the storage unit.

2. The printing apparatus according to claim 1, wherein the plurality of types of the printing media are usable, and the storage unit is configured to store the relationship for each of the printing media.

3. The printing apparatus according to claim 1, comprising a temporary curing unit configured to irradiate the ink discharged onto the printing medium with an ultraviolet ray prior to the irradiation with an ultraviolet ray by the ultraviolet irradiation unit, thereby temporarily curing the ink, wherein the printing apparatus has a temporary curing execution printing mode for performing printing by irradiating an ultraviolet ray from the temporary curing unit and a temporary curing non-execution printing mode for performing printing without irradiating an ultraviolet ray from the temporary curing unit, and the control unit is configured to control the output from the surface treatment unit at least when performing printing in the temporary curing non-execution printing mode.

4. The printing apparatus according to claim 3, wherein a plurality of types of the inks are usable, and the control unit is configured to execute control such that the printing is performed in the temporary curing non-execution printing mode when performing printing using one type of the ink.

5. The printing apparatus according to claim 3, comprising a selection unit configured to select whether to perform printing in the temporary curing execution printing mode or in the temporary curing non-execution printing mode.

6. A printing apparatus comprising:

a surface treatment unit configured to modify a surface state of a printing medium;

a head configured to discharge an ink of ultraviolet-curable type onto the printing medium having the surface state modified by the surface treatment unit, thereby forming an image;

an ultraviolet irradiation unit configured to irradiate with an ultraviolet ray the printing medium on which the image is formed by the head, thereby curing the ink;

a temporary curing unit configured to irradiate the ink discharged onto the printing medium with an ultraviolet ray prior to the irradiation with an ultraviolet ray by the ultraviolet irradiation unit, thereby temporarily curing the ink;

a selection unit configured to select whether to execute a temporary curing execution printing mode for performing printing by irradiating an ultraviolet ray from the temporary curing unit or a temporary curing non-execution printing mode for performing printing without irradiating an ultraviolet ray from the temporary curing unit; and a control unit configured to control an output from the surface treatment unit.

* * * * *